US007895811B2

(12) United States Patent
Caudle

(10) Patent No.: US 7,895,811 B2
(45) Date of Patent: Mar. 1, 2011

(54) APPARATUS AND PROCESS FOR POSITIONING A FITMENT

(75) Inventor: Timothy G. Caudle, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 1404 days.

(21) Appl. No.: 11/086,106

(22) Filed: Mar. 22, 2005

(65) Prior Publication Data

US 2006/0111224 A1 May 25, 2006

Related U.S. Application Data

(60) Provisional application No. 60/630,522, filed on Nov. 23, 2004.

(51) Int. Cl.
*B65B 61/18* (2006.01)

(52) U.S. Cl. ..... 53/133.2; 53/451; 53/133.1; 53/551; 493/212; 493/213

(58) Field of Classification Search ..... 53/451, 53/550, 551, 133.1, 133.2; 493/212, 213
See application file for complete search history.

(56) References Cited

U.S. PATENT DOCUMENTS 2,647,672 A 8/1953 Burnell
3,342,305 A 9/1967 Ochs
3,894,381 A 7/1975 Christine et al.
4,506,494 A 3/1985 Shimoyama et al.
4,533,425 A 8/1985 Wehle
4,603,793 A 8/1986 Stern
4,718,215 A 1/1988 Carveth et al.
4,779,397 A 10/1988 Christine et al.
5,467,581 A 11/1995 Everette
5,484,374 A * 1/1996 Bachner et al. ..... 493/87
6,182,426 B1 * 2/2001 Pritchard ..... 53/551
6,269,935 B1 * 8/2001 McCullen et al. ..... 198/470.1
6,722,102 B1 * 4/2004 Pape et al. ..... 53/410

* cited by examiner

*Primary Examiner*—Christopher Harmon
(74) *Attorney, Agent, or Firm*—Mark B. Quatt

(57) ABSTRACT

An apparatus for positioning and attaching a plurality of fitments to a film includes a guiding device for guiding a plurality of fitments; an attaching device for attaching the fitments to the film; a means for advancing the attached fitments and film; and an indexing device for indexing the fitments, the indexing device including a spring housing, a spring, and a fastener, the indexing device being configured such that when a first fitment has been attached to the film and then advances past the indexing device, the spring controllably releases the first fitment, and a second fitment is advanced into attaching position. A process and vertical form/fill/seal apparatus are also disclosed.

14 Claims, 6 Drawing Sheets

APPARATUS AND PROCESS FOR POSITIONING A FITMENT

This application claims the benefit of U.S. Provisional Application Ser. No. 60/630,522 filed Nov. 23, 2004, the contents of which are hereby incorporated by reference.

FIELD OF THE INVENTION

This invention relates to an apparatus and process for positioning and attaching a plurality of fitments to a film. More particularly, the invention relates to such apparatus and process for use in a form/fill/seal process.

BACKGROUND OF THE INVENTION

In the field of packaging food and non-food liquid and/or flowable and/or pumpable food and non-food products, a convenient method of packaging such products in thermoplastic film has been developed and is generally known as a form/fill/seal process. In such a process a tube is formed from thermoplastic film, a longitudinal fin or lap seal is made, and an end seal is made by transversely sealing across the tube with heated seal bars to form a conveniently wide heat seal and, consequently, producing a bag or pouch ready to receive a product. After the heat seal is made, the bag or pouch is filled and then another transverse heat seal is made across the width of the tube in a relatively wide band. After cooling, this seal is transversely severed to separate the filled bag from the next bag to be filled. Thus, one wide band seal serves as the bottom seal for one bag and the top seal for another.

Many horizontal and vertical form/fill/seal systems are commercially available from manufacturers or suppliers such as Hayssen, Omori, lapak, and Kartridge Pak.

Vertical form/fill/seal (VFFS) packaging systems have proven to be very useful in packaging a wide variety of food and non-food pumpable and/or flowable products. An example of such systems is the ONPACK™ flowable food packaging system marketed by Cryovac/Sealed Air Corporation. The VFFS process is known to those of skill in the art, and described for example in U.S. Pat. No. 4,506,494 (Shimoyama et al.), U.S. Pat. No. 4,589,247 (Tsuruta et al), U.S. Pat. No. 4,656,818 (Shimoyama et al.), U.S. Pat. No. 4,768,411 (Su), U.S. Pat. No. 4,808,010 (Vogan), and U.S. Pat. No. 5,467,581 (Everette), all incorporated herein by reference in their entirety. Typically in such a process, lay-flat thermoplastic film is advanced over a forming device to form a tube, a longitudinal (vertical) fin or lap seal is made, and a bottom end seal is made by transversely sealing across the tube with heated seal bars. A liquid, flowable, and/or pumpable product, such as a liquid, semiliquid, or paste, with or without particulates therein, is introduced through a central, vertical fill tube to the formed tubular film. Squeeze rollers spaced apart and above the bottom end seal squeeze the filled tube and pinch the walls of the flattened tube together. When a length of tubing of the desired height of the bag has been fed through the squeeze rollers a heat seal is made transversely across the flattened tubing by heat seal bars which clamp and seal the film of the tube therebetween. After the seal bars have been withdrawn the film moves downwardly to be contacted by cooled clamping and severing bars which clamp the film therebetween and are provided with a cutting knife to sever the sealed film at about the midpoint of the seal so that approximately half of the seal will be on the upper part of a tube and the other half on the lower. When the sealing and severing operation is complete, the squeeze rollers are separated to allow a new charge of product to enter the flattened tube after which the aforementioned described process is repeated thus continuously producing vertical form/fill/seal pouches which have a bottom end and top end heat seal closure.

The process can be a two-stage process where the creation of a transverse heat seal occurs at one stage in the process, and then, downstream of the first stage, a separate pair of cooling/clamping means contact the just-formed transverse heat seal to cool and thus strengthen the seal. In some VFFS processes, an upper transverse seal of a first pouch, and the lower transverse seal of a following pouch, are made, and the pouches cut and thereby separated between two portions of the transverse seals, without the need for a separate step to clamp, cool, and cut the seals. A commercial example of an apparatus embodying this more simplified process is the ONPACK™ 2002 VFFS packaging machine marketed by Cryovac/Sealed Air Corporation.

U.S. Pat. No. 4,603,793 (Stern), incorporated herein by reference in its entirety, discloses a coupling means 6*a* which is mounted on the inside wall of a pouch. Such coupling means, or fitments, offer several advantages in packaging food products, such as the capability of connecting the fitment to a pumping device. This permits the contents of the package to be dispensed in a controllable way. The particular coupling device described in U.S. Pat. No. 4,603,793 is mounted inside the pouch.

This arrangement avoids the disadvantages associated with externally mounted fitments. These include the difficulty of properly packing multiple pouch units, and the possibility that an external fitment will be damaged during handling/storage. If this happens, the food or other pouch contents can possibly leak out.

Packaging systems combining the Onpack(™) system with the fitment technology of U.S. Pat. No. 4,603,793 have proven effective in providing a pouch making system where the pouch, containing a food product, includes an internal fitment.

One of the requirements of using fitments of this general type is that they be accurately indexed and positioned to ensure that each fitment in a series of fitments is attached squarely to the film or pouch material at the appropriate location, for example by heat sealing the film to the fitment. If the fitments are not positioned accurately and consistently, they may not attach properly, and the resulting pouch or other container made from the film can possibly leak at the point where the fitment is joined to the film. In addition, inconsistent placement of the fitments with respect to the means for attaching (e.g. heat sealing means) and film can result in inconsistent attachment of a series of fitments on respective containers made from the film. Thus, for example, from pouch to pouch in a production run, the fitment on a given pouch may be located at a slightly different relative location on the pouch than another fitment on another successive pouch in the series.

U.S. Pat. No. 5,467,581 (Everette) offers an apparatus for accurately positioning fitments held in a queue for placement on pouch material. Two indexing devices shown in this reference include a multifingered wheel, and a pair of fingers with a counterweight. The former device has proven commercially useful, but still requires routine tension adjustments to insure proper performance.

The inventor has found an alternative to this technology is a device including a spring housing, a spring, and a fastener.

This device offers high accuracy, and little or no tension adjustments over the useful life of the device.

SUMMARY OF THE INVENTION

In one aspect of the present invention, an apparatus for positioning and attaching a plurality of fitments to a film comprises a guiding device for guiding a plurality of fitments; an attaching device for attaching the fitments to the film; a means for advancing the attached fitments and film; and an indexing device for indexing the fitments, the indexing device comprising a spring housing, a spring, and a fastener, the indexing device being configured such that when a first fitment has been attached to the film and then advances past the indexing device, the spring controllably releases the first fitment, and a second fitment is advanced into attaching position.

In another aspect of the invention, a process for positioning and attaching a plurality of fitments to a film comprises engaging a first fitment with an indexing device comprising a spring housing, a spring, and a fastener; attaching the first fitment to the film; and advancing the film, with the first fitment attached thereto, such that as the first fitment advances past the indexing device, the spring of the indexing device flexes sufficiently to release the first fitment, and then return to its original position ready to engage a subsequent fitment, and advancing a second fitment into attaching position.

In a third aspect of the invention, a vertical form/fill/seal apparatus comprises a forming device; a longitudinal heat sealing device; a pair of film drive belts or wheels; transverse heat seal bars; and an apparatus for positioning and attaching a plurality of fitments to a film comprising a guiding device for guiding a plurality of fitments; an attaching device for attaching the fitments to the film; a means for advancing the attached fitments and film; and an indexing device for indexing the fitments, the indexing device comprising a spring housing, a spring, and a fastener, the indexing device being configured such that when a first fitment has been attached to the film and then advances past the indexing device, the spring controllably releases the first fitment, and a second fitment is advanced into attaching position.

BRIEF DESCRIPTION OF THE DRAWINGS

The present invention is illustrated by reference to the following drawings, encompassing different views of various embodiments of the invention, wherein.

DETAILED DESCRIPTION OF THE INVENTION

Figure 1:
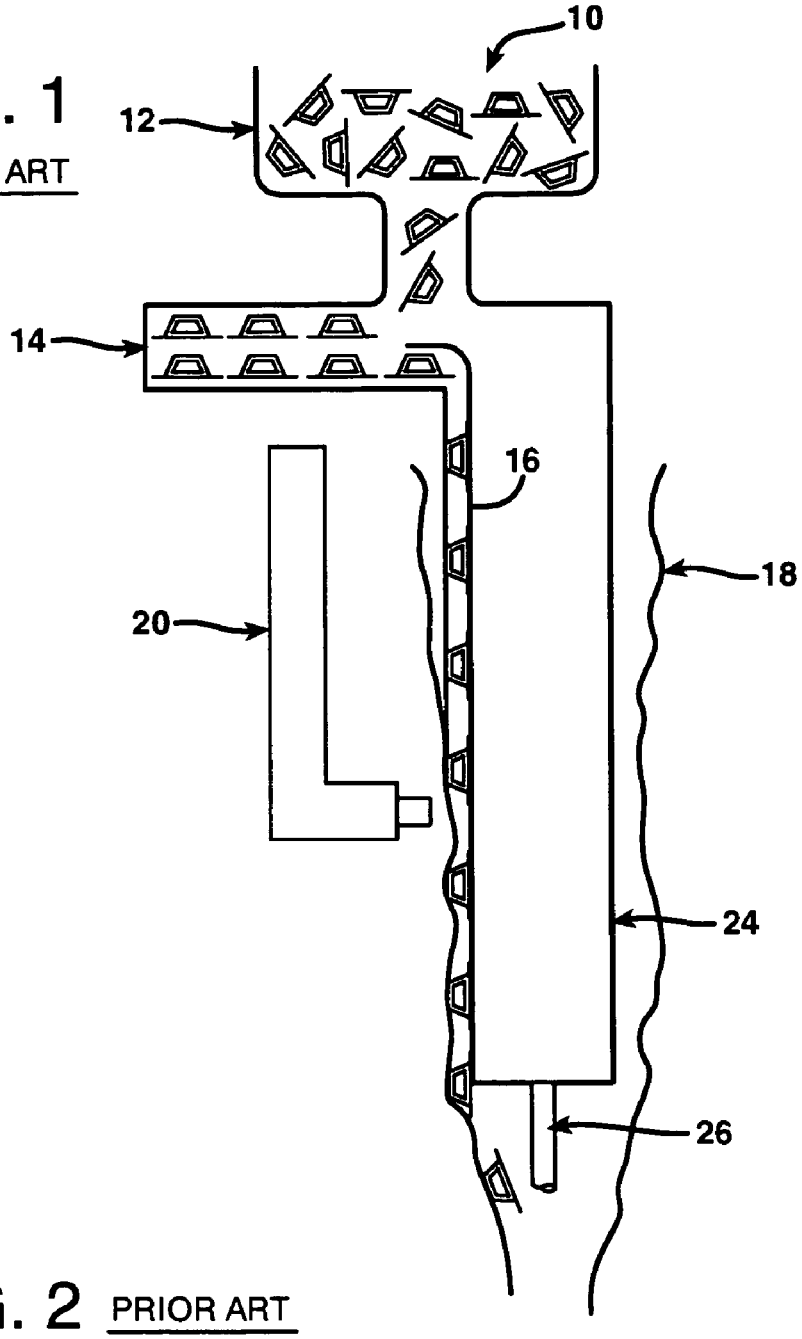
FIG. 1 PRIOR ART
FIG. 1 represents a schematic elevational view of a conventional apparatus and method of positioning and attaching a plurality of fitments to a tubular film in a vertical form/fill/seal system, some of the fitments positioned in a track.

Referring to FIG. 1, the vertical form/fill/seal (VFFS) apparatus and process of the present invention will be described as an embodiment. VFFS technology is generally well known, and conventional details of such systems need not be discussed in detail. An example of a VFFS system for use with the present invention is the ONPACK™ equipment system offered by Cryovac.

Fitments 10 are put into a hopper 12. These fitments 12 are then run through an orienter 14 to align the fitments in an appropriate direction to move down e.g. by gravity along a guiding device such as track 16. For purposes of the invention, suitable alternatives to the orienter and track can be used as long as ultimately a series of fitments are fed in sequential fashion to a location where the fitments are sequentially attached to the film passing through the VFFS system, and the fitments are temporarily arrested by the indexing device of the invention in order to permit controlled attachment of each fitment to the film, followed by advance of the film with the now attached fitment, and advancement of a sequential fitment to the same location for attachment to the film, and so on.

Figure 2:
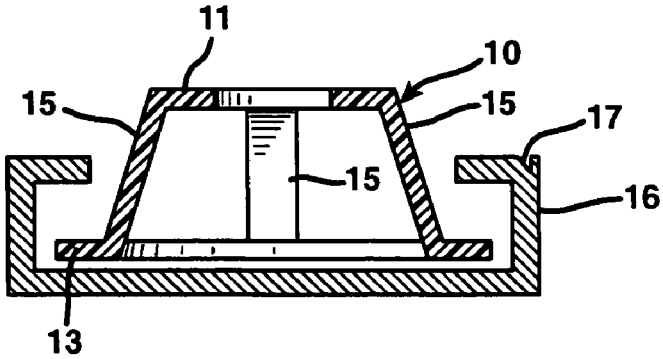
FIG. 2 PRIOR ART
FIG. 2 shows a cross section of a fitment in a track.

A cross-section of track 16 is shown in FIG. 2. Both the fitments 10 and track 16 can be of any suitable shape, size, and composition. A preferred fitment design is of the type shown in FIG. 2, and described in U.S. Pat. No. 4,603,793 (Stern) as a coupling means 6*a*.

The track 16 can be disposed along the side of mandrel 24, e.g. within a groove or indentation (not shown) in the mandrel to accommodate the track. Film 18, in the form of a sleeve, is drawn down the outside (exteriorly) of mandrel 24 and outside the track 16, but inside (interiorly) an attaching device such as a heat sealer 20. Thus, in normal operation of the VFFS system, the film 18 passes between the attaching device and the fitments. When each fitment is indexed down to the appropriate position or location adjacent the film, the heat sealer is activated to press and seal the film to the fitment. After the fitment has been attached to the film, the film is advanced downwardly, where the filling process, transverse sealing, and final pouch making occurs by means well known in the art.

The fitment 10 exemplified in FIG. 2 includes a top ring 11 and a bottom ring 13 with respective orifices therein, and legs 15. Any suitable alternative fitment design can be used in conjunction with the present invention. The track 16 optionally includes a groove 17 into which set screws or the like may be placed to attach appropriate mounting brackets for the indexing device, or the indexing device directly.

Figure 3:
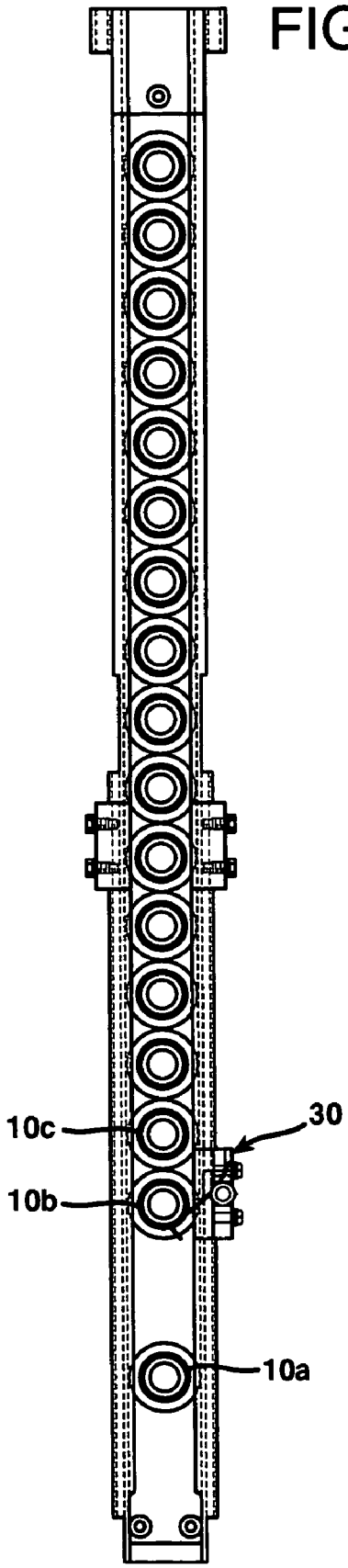
FIG. 3 shows an elevational side view of a track filled with fitments, and an indexing device according to the invention, the indexing device shown in relation to a fitment located in the track.

In FIG. 3, a track 16 is shown in which an indexing device 30 of the invention is shown attached along a lower portion of the track. A series of fitments 10 is shown, vertically stacked within the track 16. FIG. 3 illustrates the invention at a point in time in which the lowermost fitment 10*a* is attached to the film 18 (not shown for clarity), while a following fitment 10*b* is in a position where it is temporarily arrested by action of the indexing device of the invention. After the fitment 10*b* has been attached to the film by action of the attaching device, e.g. heat sealer 20, the film (with fitment 10*b* now attached) is advanced. The downward movement of the film, carrying attached fitment 10*b* with it, overcomes the resistance of the spring of the indexing device to release the fitment 10*b* from the indexing device. A subsequent fitment 10*c* then falls (or is otherwise advanced to the attaching location in non-vertical embodiments) where fitment 10*c* will be temporarily arrested by the spring of indexing device 30, the fitment 10*c* is then attached to the film, and the cycle is repeated.

After attachment of a fitment 10 to film 18, the film is advanced downwardly, of course bringing the attached fitment with it. The force exerted on the film, and therefore the attached fitment, pulls the attached fitment further down the track 16. This in turn releases the fitment from the spring of the indexing device, allowing the next fitment to drop down into place, caught by the spring.

Figure 4:
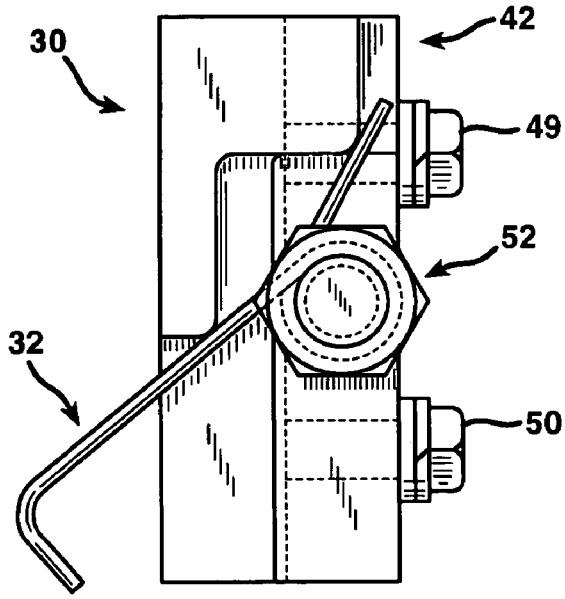
FIG. 4 is a side view of the indexing device of the invention.

FIG. 4 is a side view of the indexing device 30 of the invention. This device includes a spring 32, a spring housing 42, and a fastener 52.

Figure 5:
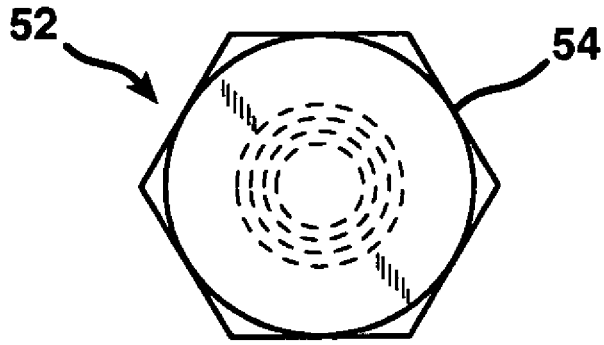
FIG. 5 is a top view of a fastener of the invention.

FIG. 5 is a top view of the fastener 52 of the invention, showing a bolt head 54. In one embodiment, the fastener 52 is a threaded bolt. Fastener 52 attaches spring 32 to the spring housing 42. In the particular embodiment shown in FIGS. 3, 4, and 11, the fastener 52 holds the spring 32 to the spring housing 42, and also permits removal of the spring 32 for cleaning, replacement, etc. In alternative embodiments, the fastener 52 comprises a rivet, clamp, or any other means for attaching the spring 32 to the spring housing 42.

Figure 6:
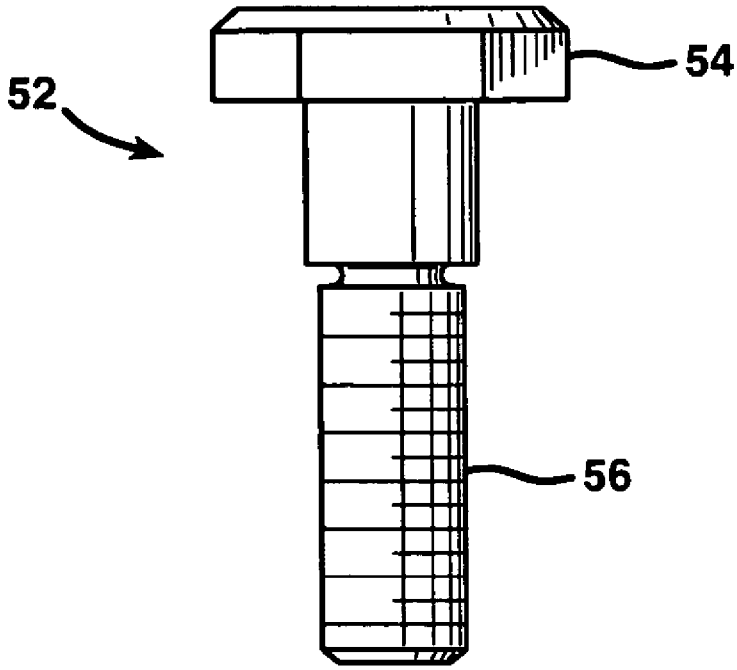
FIG. 6 is an elevational view of the fastener of the invention.

FIG. 6 is an elevational view of the fastener 52 of the invention, showing a threaded shaft 56.

Figure 7:
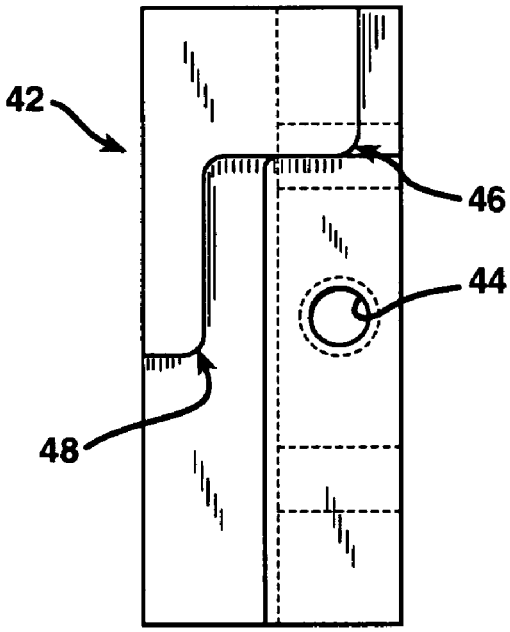
FIG. 7 is a front view of the spring housing of the invention.
Figure 8:
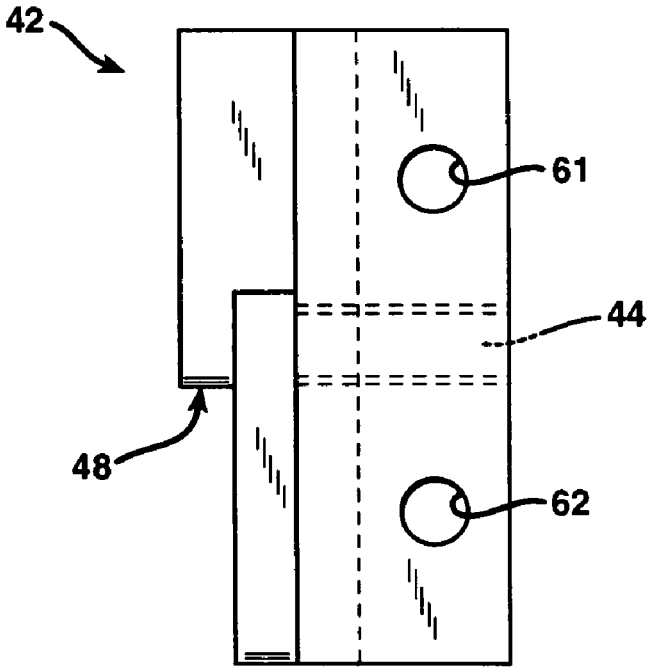
FIG. 8 is a side view of the spring housing of the invention.
Figure 11:
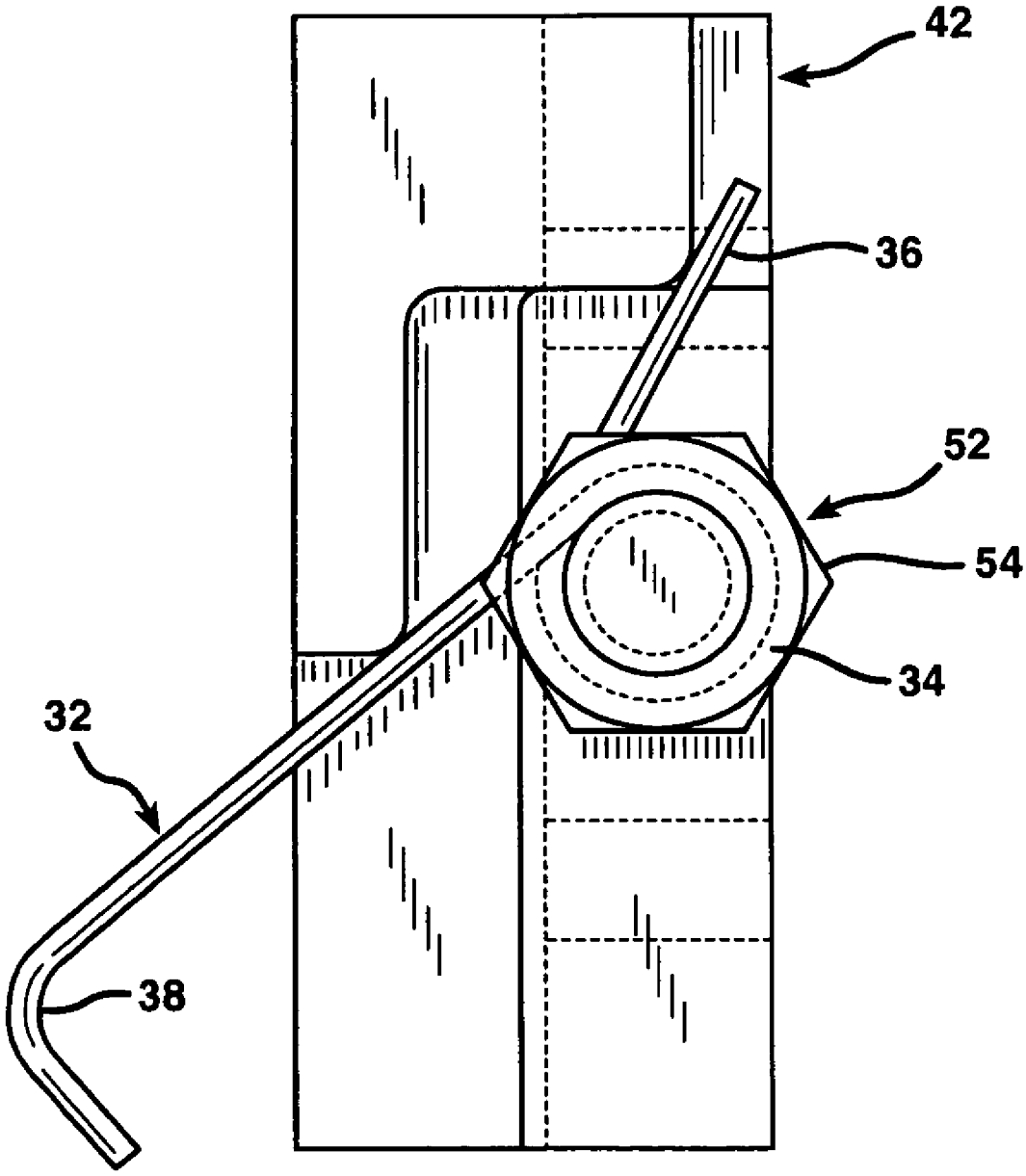
FIG. 11 is an enlarged front view of the indexing device of the invention.

FIGS. 7 and 8 illustrate a front and side view respectively of the spring housing 42 of the invention. The spring housing 42 can be of any suitable configuration, provided it accommodates the spring 32 so that the spring can operatively engage successive fitments and then release these in sequential fashion as described herein. Spring housing 42 includes a orifice 44 for attachment of the spring 32 to the housing by means of the fastener 52. Spring housing 42 also includes a first indent 46 that, as shown in FIGS. 4 and 11, engages a terminal portion of the spring 32 to prevent free rotation of the spring 32 so that the spring will exert a spring force on each fitment as disclosed herein. Spring housing 42 also includes a second indent 48 that, as shown in FIGS. 4 and 11, engages a portion of the spring 32 to properly position the operative arm of the spring (the arm that engages each fitment) so that the spring is oriented to optimally catch and subsequently release each successive fitment in operation. Those skilled in the art will recognize, after a review of this disclosure, that the angle at which the spring is positioned, and the specific configuration of the first and second indents of spring housing 42, can be optimized taking into consideration the nature and size of the fitments used, the spring constant of the spring, the overall geometry of the equipment, the desired resistance to advancement of the fitment, etc. Fasteners 49 and 50 (see FIG. 4) can be used to attach the spring housing 42 to the track 16 or other suitable component of the overall apparatus. As shown, fasteners 49 and 50 comprise threaded bolts that are accommodated in orifices 61 and 62 respectively.

Figure 9:
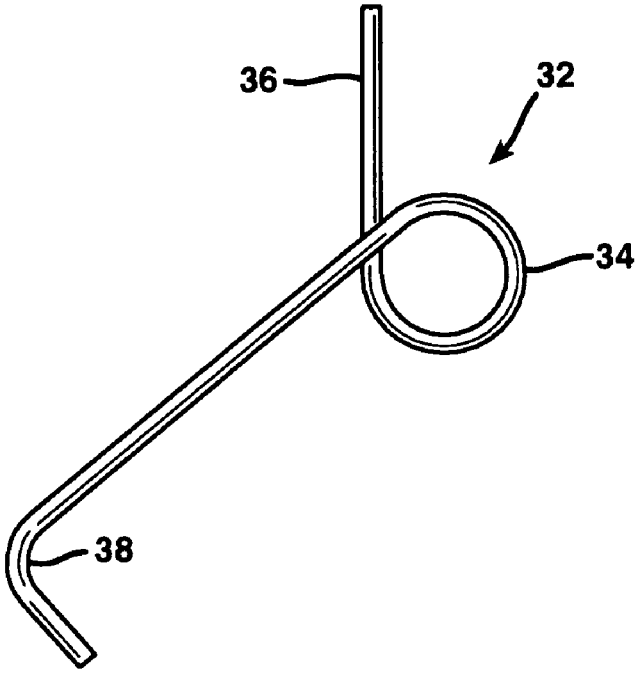
FIG. 9 is a front view of the spring of the invention.
Figure 10:
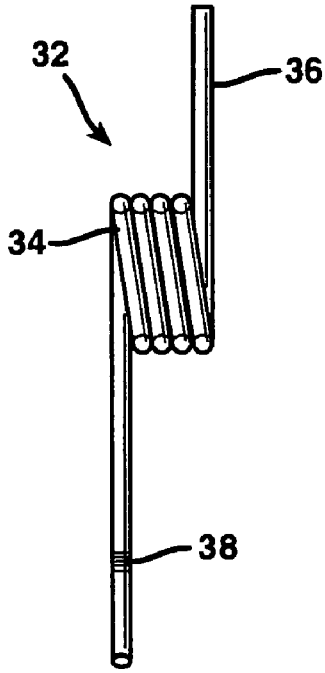
FIG. 10 is a side view of the spring of the invention.

FIGS. 9 and 10 are a front and side view, respectively, of the spring of the invention. Spring 32 includes a circular portion 34 including a number of helical winds; a first terminal portion 36, and a second terminal portion 38. The circular portion 34 is adapted to admit the fastener 52 described above for the purpose of attaching spring 32 to spring housing 42. The first terminal portion 36 is adapted to engage first indent 46. The second terminal portion 38 is adapted to engage second indent 48. The spring can have any suitable spring constant, such as from 0.026 to 0.032 pound-inches/degree, such as 0.0288 pound-inches/degree.

FIG. 11 is an enlarged front view of the indexing device of the invention.

The spring 32 is characterized by a spring constant chosen such that the force exerted on the spring by fitments 10 in the track (by reason of a first fitment attached to the film and held by the spring, the plurality of fitments positioned above the first fitment in embodiments where the fitment guide is vertically disposed, and any component of the film weight that may be applied to the spring) will not torque the spring sufficiently to prematurely release the first fitment, but still allow the spring to release the first fitment during advancement of the fitment after attachment to the film, when the system is operated to advance the film. Of course, as each subsequent fitment is attached to the film and engaged by the spring, this same controllable release operates to provide for the sequential attachment, release, and advancement of the plurality of fitments during a package production run. The invention has proven to be highly reliable, with relatively little need for maintenance or adjustment, and a relatively long spring life.

In an alternative embodiment, the indexing device can be mounted directly to the track 16 or other suitable guiding device for guiding a plurality of fitments, as long as the relative dimensions of the guiding, attaching, and indexing means allow for appropriate clearance of parts, and operation of the apparatus and process as herein described. In this alternative embodiment, the spring housing can simply comprise a support or other component of the guiding device for guiding a plurality of fitments. For example, the spring housing can be a segment of the track 16. The spring housing can thus be an integral part of the guiding device.

It is to be understood that variations and modifications of the present invention may be made without departing from the scope of the invention. It is also understood that the scope of the invention is not to be interpreted as limited to the specific embodiments disclosed herein, but only in accordance with the appended claims when read in light of the foregoing disclosure. The detailed description of certain embodiments is given by way of illustration only since numerous changes and modifications well within the spirit and scope of the invention could become apparent to those already skilled in the art in view of the description herein. For example, although the means for attaching is described as a heat sealing means, other means, such as application of an adhesive, can be used. Although described with reference to VFFS technology, this invention can be adapted to other packaging systems. The guiding device for guiding a plurality of fitments is described herein in one embodiment as a track which is shown as a vertically disposed guide that allows fitments to be vertically queued and to drop by gravity toward an attachment point as the system operates. Alternative embodiments can operate by some applied force, such as a pneumatic force, rather than simply relying on gravity for fitment advancement. Also, the fitments can be queued and advanced in a non-vertical orientation.

Films suitable for use in the present invention are well known, generally being polymeric thermoplastics. Those skilled in the art will appreciate, after a review of this specification, that the apparatus and process of the invention can be carried out with any appropriate film; preferred are thermoplastic, polymeric films such as those designed for VFFS applications. An example is FS 7055™ film sold by Cryovac/Sealed Air Corporation. Generally, the film is sealed at the lowest possible temperature at which relatively strong seals are produced. In general, the film is sealed at a temperature of from about 150° C. to 210° C. "Film" is used herein to mean films, laminates, and webs, either multilayer or monolayer, that may be used in connection with the present invention. The FS laminates, such as FS 7055™, sold by Sealed Air Corporation through its Cryovac Division, are examples of packaging materials suitable for the VFFS process. These laminates are described in e.g. U.S. Pat. No. 4,746,562 (Fant), incorporated herein by reference in its entirety. An alternative laminate is based on SCLAIR™ sealant film, an ethylene/alpha-olefin copolymer marketed by DuPont Canada, and described in e.g. U.S. Pat. No. 4,521,437 (Storms), incorporated herein by reference in its entirety. A commercial monolayer film from DuPont Canada is FS-3. A commercial multilayer laminate is CL 303. Many other films and laminates useful for dry or wet fluid packaging are available, and can be beneficially used in the present invention.

The present invention can be used for packaging wet flowable and/or pumpable products including low viscosity fluids (e.g. juice and carbonated beverages), high viscosity fluids (e.g. condiments and sauces), fluid/solid mixtures (e.g. soups), gels, etc. Non-food products such as fertilizers, motor oil and engine additives, dry and wet cosmetics, medicaments, medical powders such as foot and talcum powder, sand, cement, and the like can also be beneficially packaged in pouches of the present invention. The present invention finds particular utility in packaging dry flowable and/or pumpable products. These include very finely divided or comminuted products such as flour and cake mixes; somewhat coarser products such as spices and sugar; and even coarser products such as rice and breakfast cereal. Products with larger particulates such as pet food, and non-food dry flowable and/or pumpable products can be beneficially packaged.

The present invention can be used in combination with, or as a subsystem of, a variety of equipment systems. A preferred end use is in VFFS applications, for use in such commercially available equipment as ONPACK™ 2070, 2002, and 2050 VFFS packaging equipment.

What is claimed is:

1. An apparatus for positioning and attaching a plurality of fitments to a film, comprising:

a) a guiding device for guiding a plurality of fitments;

b) an attaching device for attaching the fitments to the film;

c) a means for advancing the attached fitments and film; and d) an indexing device for indexing the fitments, the indexing device comprising i) a spring housing, ii) a spring, and iii) a fastener, the indexing device being configured such that when a first fitment has been attached to the film and then advances past the indexing device, the spring controllably releases the first fitment, and a second fitment is advanced into attaching position; and wherein the spring can operatively engage each fitment by catching each fitment, and can then release each fitment in sequential fashion.

2. The apparatus of claim 1 wherein the apparatus forms part of a vertical form/fill/seal system.

3. The apparatus of claim 1 wherein the guiding device for guiding a plurality of fitments comprises a track.

4. The apparatus of claim 1 wherein the attaching device for attaching the fitments to the film comprises a heat seal device for heat sealing the fitments to the film.

5. The apparatus of claim 1 wherein the spring has a spring constant ranging from 0.026 to 0.032 pound-inches/degree.

6. A process for positioning and attaching a plurality of fitments to a film, comprising:

a) engaging a first fitment with an indexing device comprising i) a spring housing, ii) a spring, and iii) a fastener;

wherein the spring engages the first fitment by catching the first fitment;

b) attaching the first fitment to the film;

c) advancing the film, with the first fitment attached thereto, such that as the first fitment advances past the indexing device, the spring of the indexing device flexes sufficiently to release the first fitment, and then return to its original position ready to engage a second fitment by catching the second fitment; and d) advancing the second fitment into attaching position.

7. The process of claim 6 wherein the process for positioning and attaching a plurality of fitments to a film forms part of a vertical form/fill/seal process.

8. The process of claim 6 wherein the process for positioning and attaching a plurality of fitments to a film further comprises, prior to step (a), guiding a plurality of fitments to an attaching device for sequentially attaching the fitments to the film.

9. The process of claim 6 wherein the step of attaching the first fitment to the film comprises heat sealing the first fitment to the film.

10. The process of claim 6 wherein the first fitment is advanced by advancing the film to which the first fitment is attached.

11. A vertical form/fill/seal apparatus comprising:

a) a forming device;

b) a longitudinal heat sealing device;

c) a pair of film drive belts or wheels;

d) transverse heat seal bars; and e) an apparatus for positioning and attaching a plurality of fitments to a film, comprising:

i) a guiding device for guiding a plurality of fitments;

ii) an attaching device for attaching the fitments to the film;

iii) a means for advancing the attached fitments and film; and iv) an indexing device for indexing the fitments, the indexing device comprising (a) a spring housing, (b) a spring, and (c) a fastener, the indexing device being configured such that when a first fitment has been attached to the film and then advances past the indexing device, the spring controllably releases the first fitment, and a second fitment is advanced into attaching position; and wherein the spring can operatively engage each fitment by catching each fitment, and can then release each fitment in sequential fashion.

12. The apparatus of claim 11 wherein the guiding device for guiding a plurality of fitments comprises a track.

13. The apparatus of claim 11 wherein the attaching device for attaching the fitments to the film comprises a heat seal device for heat sealing the fitments to the film.

14. The apparatus of claim 11 wherein the spring has a spring constant ranging from 0.026 to 0.032 pound-inches/degree.

* * * * *